United States Patent [19]

Stern et al.

[11] Patent Number: 4,691,783

[45] Date of Patent: Sep. 8, 1987

[54] AUTOMATIC MODULAR FIRE EXTINGUISHER SYSTEM FOR COMPUTER ROOMS

[75] Inventors: Geoffrey S. Stern, New York, N.Y., Israel; Zion Avni, Kfar Saba, Israel; Amos Gonen, Herziliya, Israel; Amiram Peleg, Beit Yehoshua, Israel

[73] Assignee: Spectronix Ltd., Tel-Aviv, Israel

[21] Appl. No.: 836,682

[22] Filed: Mar. 6, 1986

[51] Int. Cl.[4] ..... A62C 35/02; A62C 37/04

[52] U.S. Cl. ..... 169/61; 169/70; 169/19; 169/26

[58] Field of Search ..... 169/19, 26, 28, 51, 169/54, 56, 61, 70

[56] References Cited

U.S. PATENT DOCUMENTS

| | | | |
|---|---|---|---|
| 3,811,511 | 5/1974 | McCulloch | 169/28 |
| 3,866,687 | 2/1975 | Banner | 169/26 X |
| 3,993,138 | 11/1976 | Stevens et al. | 169/61 |
| 4,270,163 | 6/1981 | Spector et al. | 169/61 |

FOREIGN PATENT DOCUMENTS

| | | | |
|---|---|---|---|
| 2523455 | 9/1983 | France | 169/61 |

OTHER PUBLICATIONS

Williams, J., "Detect, Spray Computer-Room Fire in 5 Sec.", Electric World (McGraw Hill), vol. 185, No. 7, p. 34, Apr. 1, 1976.

"Fike Engineered & Pre-Engineered Fire Suppression Systems", Form No. B9028-5.

"Chemetron Fire Systems Full-Line 360/600 Halon 1301", Folio 7-9.

"Halon 1301 Acceptance Tests", *The Sentinel*, Third Quarter 1985, pp. 8-9.

F. I.: 85-1 NFPA 12A Ref. 1-9.5.1, 2-5.2, Dec., 1985.

*Primary Examiner*—Andres Kashnikow

*Attorney, Agent, or Firm*—Browdy and Neimark

[57] ABSTRACT

A module for use in a fire extinguishing system and comprising a housing which contains detector apparatus for detecting characteristics of a fire or an incipient fire; control apparatus adapted to be actuated by detection at the detector apparatus; and fire extinguishing apparatus adapted to be discharged by the control apparatus.

13 Claims, 3 Drawing Figures

AUTOMATIC MODULAR FIRE EXTINGUISHER SYSTEM FOR COMPUTER ROOMS

FIELD OF THE INVENTION

The present invention relates to a pre-engineered module which contains fire detection, control and fire extinguishing elements.

BACKGROUND OF THE INVENTION

Known fire detection and extinguishing systems, to whatever extent they may be pre-engineered, conventionally use piping to convey fire extnguishing agent from a storage point to the required points of distribution. There are also known selfcontained systems which require wall mounting and are not, therefore, centrally located for most efficient agent distribution.

The installation of such systems is labor-intensive and is generally inconvenient, since it is likely to involve the shut down of the room in which such systems are to be installed. Furthermore, quality control is hard to achieve for on-site assembly. Thus, while the actual cost of installation of such systems is high, the economic losses resulting from the shutting down of the operations normally taking place in the room may be even higher. Similar factors also apply, but to a lesser extent, as regards periodical maintenance of fire detection and extinguishing equipment which has previously been installed.

A fire protection problem which exists at the present time relates to the widespread and increasing use of computers. Computers and auxillary equipment therefore are usually allocated one or more special rooms, which then need protection against fire. On the other hand, it is frequently the case that the users of computers depend on their continuous accessibility, so that the installation of fire protection equipment in a computer room should desirably be carried out with minimum interruption of the normal functioning and accessibility of the apparatus therein. Furthermore, floor space in an environment controlled computer room is exceedingly expensive. It is believed that this need is not adequately met by the fire protection equipment available at the present time.

It is a principal object of the present invention to provide fire protection apparatus which overcomes the drawbacks mentioned above, and in particular is suitable for installation in a computer room. Further objects of the invention will appear from the description which follows.

SUMMARY OF THE INVENTION

The invention accordingly provides a module for use in a fire extinguishing system and comprising a housing which contains detector apparatus for detecting characteristics of a fire or an incipient fire; control apparatus adapted to be actuated by detection at the detector apparatus; and fire extinguishing apparatus adapted to be discharged by the control apparatus.

The invention also relates to a room, and more particularly a computer room, containing the module of the invention. Further optional or preferred features of the module and of the room containing it, and more especially to a computer room containing the module, will appear from the detailed description which follows.

The detector apparatus forming part of the module may comprise smoke, heat and/or radiation detector apparatus. Such smoke detector apparatus may be adapted to detect visible smoke, or invisible smoke produced for example by vapors derived from polyvinyl chloride, and may be ionization smoke detector apparatus. Such heat detector apparatus may be, for example, rate of temperature rise detector apparatus. Such radiation detector apparatus may be, for example, either or both of ultraviolet and infrared radiation apparatus.

The fire extinguishing apparatus forming part of the module may comprise, for example, at least one steel container filled with extinguishing agent and terminated by a discharge valve. It is preferred that the extinguishing apparatus comprises a plurality of typically steel containers, and that each discharge valve is adapted to discharge said extinguishing agent by a signal from the control apparatus. The discharge valve is preferably adapted additionally so as to discharge the extinguishing agent by manual control apparatus, or alternatively by a thermal sensor device contained within the valve.

The fire extinguishing agent may comprise any such agent which is known to be effective and is in use for extinguishing fires in a room, but is preferably Halon 1301 contained within one or more, e.g. a plurality, of steel containers, which may be superpresurized with nitrogen, as for example at a gauge pressure of about 200–360 psi $\pm 5\%$ at 70 degrees F. Each such container may, for example, be adapted to contain an amount of the extinguishing agent in the range of about 5 to about 50 lbs. The amount of extinguishing agent will preferably be such as to give a concentration thereof in the room of about 5 to about 70%.

The control apparatus forming part of the module may comprise a logic circuit arrangement, which is preferably microprocessor based and adapted to discharge the fire extinguishing apparatus by generation of an electrical pulse.

In a particular embodiment of the invention, there is provided a module for use in a fire extinguishing system and comprising a housing which contains detector apparatus for detecting characteristics of a fire or an incipient fire; a logic circuit arrangement adapted to be actuated by detection at the detector apparatus; and fire extinguishing apparatus comprising two spherical or ellipsoidal steel containers each of which is filled with extinguishing agent and terminated by a discharge valve, the latter being adapted to discharge the extinguishing agent by an electrical pulse from the logic circuit arrangement, and in the alternative by manual control apparatus, or by a thermal sensor device contained within the valve.

In a further embodiment of the invention there is provided a module for use in a fire extinguishing system and comprising a housing which contains detector apparatus for detecting characteristics of a fire or an incipient fire; control apparatus adapted to be actuated by detection at the aforementioned detector apparatus and additionally by detection of detector apparatus external of the housing; and fire extinguishing apparatus adapted to be discharged by the control apparatus. Each detector apparatus may comprise smoke, heat or(and) radiation detector apparatus (as described hereinabove), and the external detector apparatus may be the same as or different from the detector apparatus within the housing.

In another aspect, the invention provides a room protected against fire by ceiling installation within the room of the module described hereinabove. Preferably, any detector apparatus external of the housing is also ceiling installed within the room at a location remote from the module.

The module of the invention may, from one point of view, be used in any room, more particularly one having a room volume in the range of about 500 to about 4800 cubic feet. However, from another point of view the module of the invention will be particularly suitable for installation in a computer room, or for that matter in other rooms containing expensive equipment. The reason for this is that corporations or other institutions which use computers (for example) often become so dependent upon them, that to shut down their operation (or even to interrupt it for any protracted period) in order to install or check the conventional fire extinguishing systems, would be likely to have undesirable economic consequences. With regard to the present system, however, it is noteworthy that this has the following advantageous characteristics:

(i) it occupies only a nominal amount of space, with minimal interference to the normal activities of a computer room, and the module itself may readily be designed so that it exactly replaces a standard 2×4 ft. suspended ceiling tile;

(ii) inspection of the system is relatively simple and will also cause the minimum of disruption to the normal use of a computer room;

(iii) the cylinder assembly may easily be designed to facilitate rapid replacement of cylinders after discharge;

(iv) it may be designed so that both installation and maintenance need be carried out by only one person; and (v) the system is readily integrable with computers, air conditioning and other equipment, so that on the one hand placement of the module is such that this equipment will not interfere with distribution of the extinguishing agent, and on the other hand, the equipment may be switched off simultaneously with the operation of the fire extinguishing apparatus.

Thus, in accordance with yet a further aspect of the invention, there is provided a computer room, which contains one or more computers and optionally air conditioning and other electrical apparatus, and which is protected against fire by ceiling installation within the room of a module which comprises a housing which contains: detector apparatus for detecting characteristics of a fire or an incipient fire; control apparatus adapted to be actuated by detection at the detector apparatus; and fire extinguishing apparatus adapted to be discharged by the control apparatus; and wherein the control apparatus is further adapted, when actuated by the detection, to switch off the one or more computers and optionally air conditioning and other electrical apparatus.

In still a further aspect of the invention, there is provided a computer room, which contains one or more computers and optionally air conditioning and other electrical apparatus, and which is protected against fire by ceiling installation within the room of a module which comprises a housing which contains: detector apparatus for detecting characteristics of a fire or an incipient fire; a logic circuit arrangement adapted to be actuated by detection at the detector apparatus; and fire extinguishing apparatus comprising two spherical or ellipsoidal steel containers each of which is filled with extinguishing agent and terminated by a discharge valve; and wherein the discharge valve is adapted to discharge the extinguishing agent by an electrical pulse from the logic circuit arrangement, and in the alternative by a manual control apparatus, or by a thermal sensor device contained within the valve; and wherein the logic circuit arrangement is further adapted, when actuated by the detection, or in the alternative by the manual control apparatus, to switch off the one or more computers and optionally air conditioning and other electrical apparatus.

Moreover, in a preferred embodiment there is provided by the invention a computer room, which contains one or more computers and optionally air conditioning and other electrical apparatus, and which is protected against fire by ceiling installation within the room of a module which comprises a housing which contains: detector apparatus for detecting characterisics of a fire or an incipiet fire; a logic circuit arrangement adapted to be actuated by detection at said detector apparatus and additionally by detection at detector apparatus which is ceiling installed within the room at a location remote from the housing; and fire extinguishing means adapted to be discharged by the control apparatus; and wherein the logic circuit arrangement is further adapted, when actuated by the detection, to switch off the one or more computers and optionally air conditioning and other electrical apparatus.

In a particularly preferred embodiment, the invention provides a computer room, which contains one or more computers and optionally air conditioning and other electrical apparatus, and which is protected against fire by ceiling installation within the room of a module which comprises a housing which contains: detector apparatus for detecting characteristics of a fire or an incipient fire; a logic circuit arrangement adapted to be actuated by detection at the detector apparatus and additionally by detection at detector apparatus which is ceiling installed within the room at a location remote from the housing; and fire extinguishing apparatus comprising two spherical or ellipsoidal steel containers each of which is filled with extinguishing agent and terminated by a discharge valve; and wherein the discharge valve is adapted to discharge the extinguishing agent by an electrical pulse from the logic circuit arrangement, and in the alternative by manual control apparatus or by a thermal sensor device contained within the valve; and wherein the logic circuit apparatus is further adapted, when actuated by the detection, or in the alternative by the manual control apparatus, to switch off the one or more computers and optionally air conditioning and other electrical apparatus.

In any of the embodiments of the invention, the control apparatus (which can of course comprise a logic circuit arrangement) may be still further adapted, when actuated by detection at the detection apparatus, to trigger alarm apparatus. This alarm apparatus may include, for example, one or more of the following, namely, a bell, a siren, and a visual alarm unit, any of which may be located inside or outside of the room, and an automatic dialer.

In an additional aspect of the invention, there is provided a room (e.g. a computer room) protected against fire by a plurality of the modules of the invention. In one embodiment, where in particular the room is of such a size to warrant this, as for example where it is of volume over about 4800 cubic feet, a plurality of modules may be ceiling installed. In another embodiment, where the room comprises a space beneath a raised floor, then in this space at least one module of said plurality of modules may be installed. All of the detail which has been described above in relation to rooms (e.g. computer rooms) which contain a single module of the invention, are correspondingly applicable when such rooms contain a plurality of modules of the invention.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1:
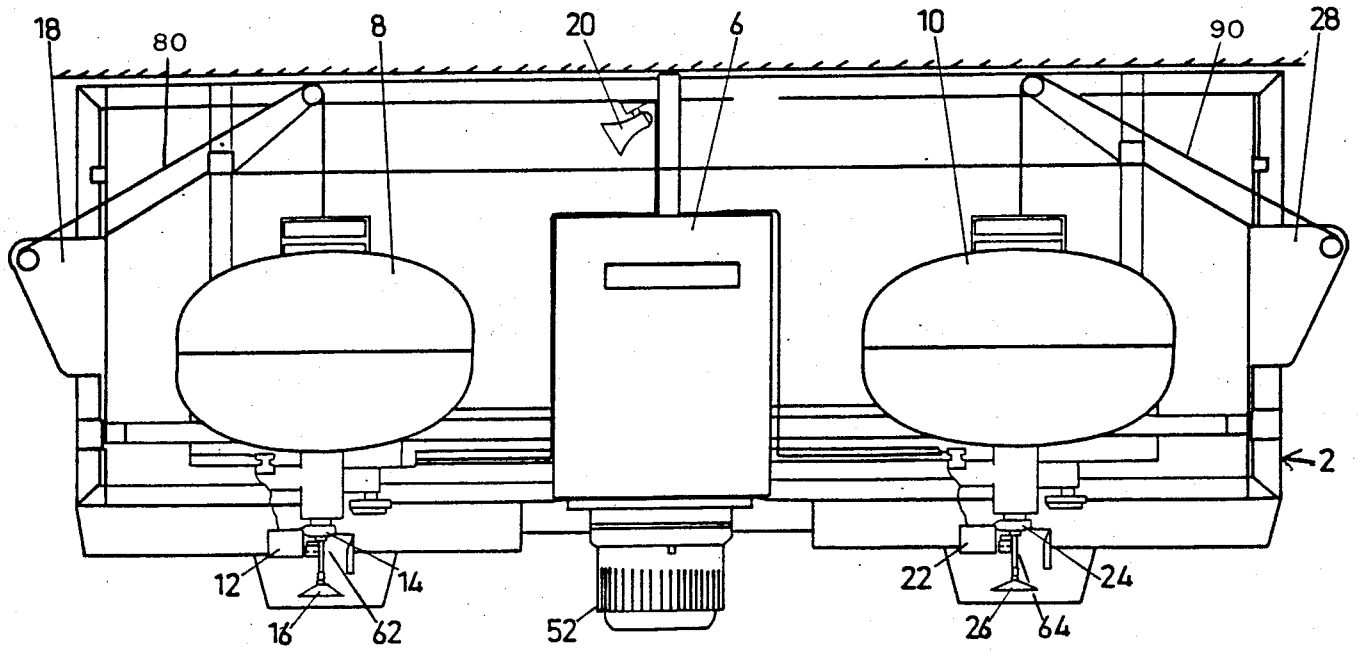
FIG. 1 is a side view of a module of the invention.

In FIG. 1, the housing of the module of the invention is shown generally at 2. It contains, in this embodiment, a pair of steel containers 8, 10, filled with (e.g.) Halon extinguishant, each terminated by discharge valves 14, 24, and each arranged to be selectably lowered by winches 18, 28, (which normally are not retained in the module, but are attached when required) and pulleys 80, 90.

A detector is located at 52 and a box 6 contains control apparatus, e.g. logic circuit apparatus, which is adapted to be actuated by a signal from the detector; the control apparatus in turn actuates the discharge valves, as for example by electrical impulses conveyed via assemblies 12, 22, to discharge the extinguishing agent via deflectors 16, 26 and through extinguishihg fluid distribution nozzles 62, 64. Simultaneously, the control apparatus gives alarm signals, as e.g. by sounding horn 20. Alternatively, discharge may be affected by a manual control, or by thermal sensors located within the valves.

Figure 2:
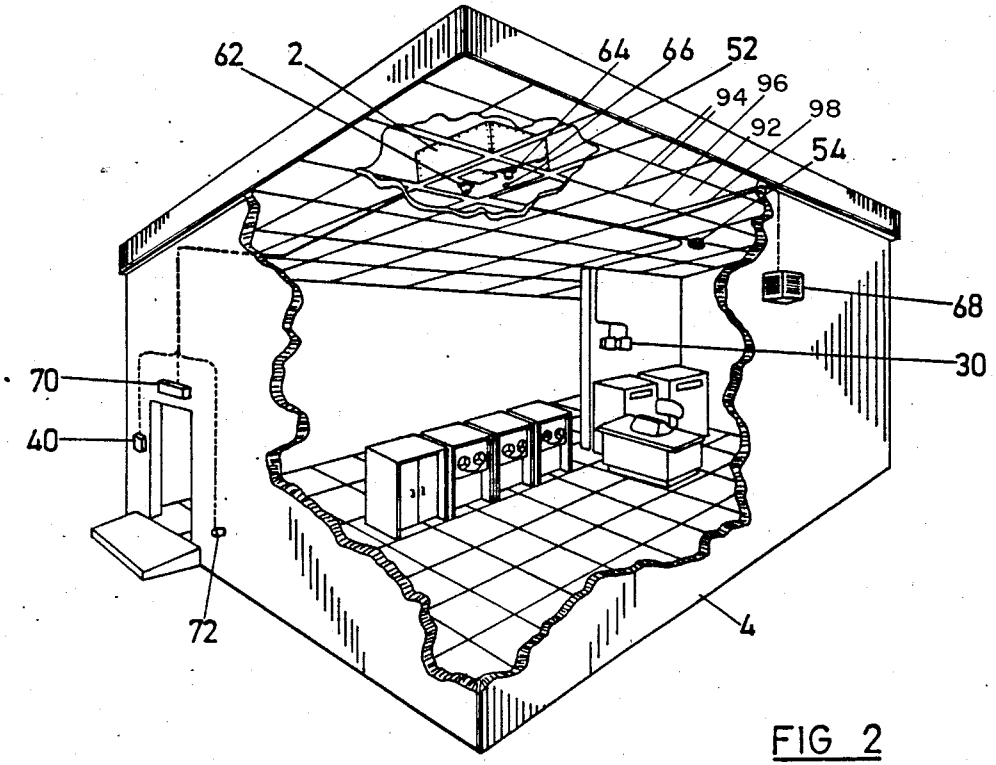
FIG. 2 is a pictorial partly cut away view of a room containing a module of the invention.

In FIG. 2, module 2 has replaced a standard 2×4 ft. ceiling tile in computer room 4. The ceiling comprises removable tiles 92 supported by supports 94, 96, 98 forming one block of the overall suspension grid. Visible on the lower surface of the module are detector 52, extinguishing fluid distribution nozzles 62, 64 and control box panel 66. In FIG. 2, the detection of fire is affected additionally by means of detector 54, which is also situated on the room ceiling at a location remote from the module. Other features shown in this FIG. are external siren 68 and visual and/or audio fire alarm 70, which may be operated simultaneously with actuation at the fire extinguisher discharge valves, that is to say as a result of detection at either or both of detectors 52, 54 after processing the signal(s) in the control apparatus, or alternatively as a result of manual activation at remote manual activation 40 outside the room. In yet another alternative, the extinguishing cylinders are discharged due to the reaction of a thermal sensor (not shown) to a rise to a particular temperature threshold, and discharge again actuates all the relevant alarm mechanisms. Also operative on a signal from the control apparatus via switching unit 30 are door holder 72 as well as shut down operations (not shown).

Figure 3:
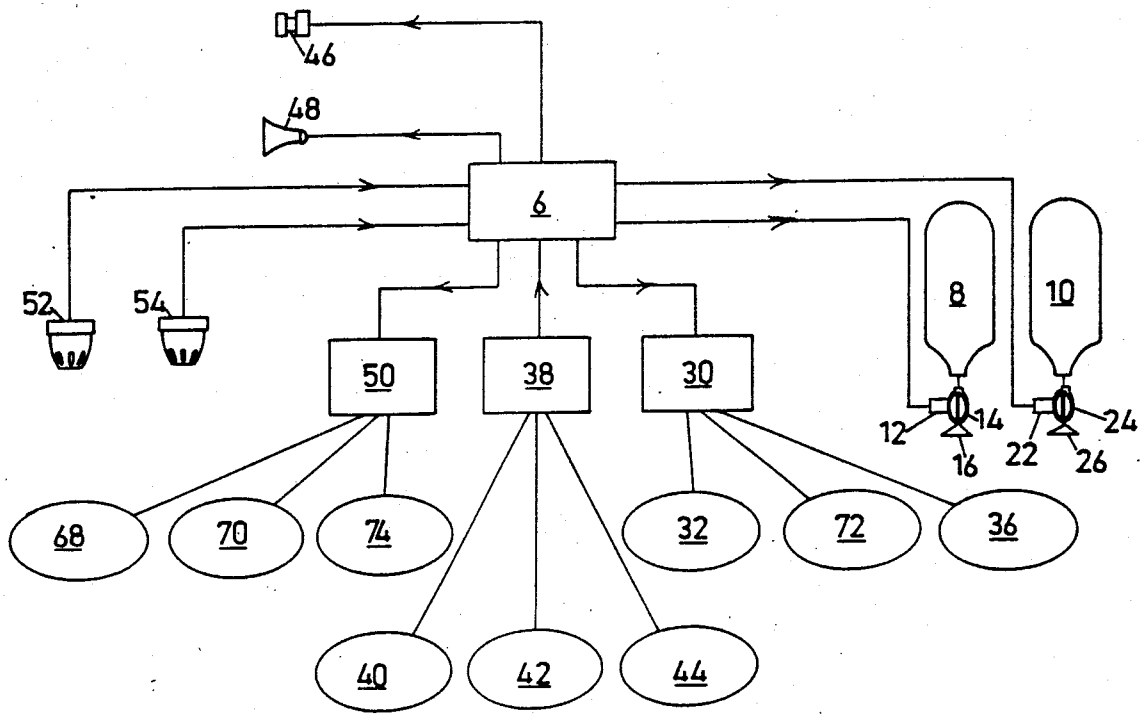
FIG. 3 is a block diagram of an extinguishing system in accordance with the invention.

The block diagram of FIG. 3 shows schematically the operation of a system using the module of the invention. Input to the electronic control box 6 is from module-contained detector 52 or/and remote detector 54, or alternatively from remote control units 38 which may include remote manual activation 40 (with optional power source independent from that of the module), remote abort/delay unit 42 (to delay discharge of the extinguishing agent, at least for a specified time period, say 60 secs., unless the instruction is renewed), and radio controlled activation unit 44, the use of which would obviate the necessity for wiring. The FIG. shows five types of output. The buzzer 46 gives notice of a fault in the system which requires attention. Internal siren 48 sounds the alarm inside the room. Warning subsystem 50 generates a more extensive external alarm response, including external siren 68, visual alarm unit 70 and automatic dialler 74. Switching unit 30 directs the shut down of air conditioning 32, operates door holders 72 and directs shut down of electrical equipment 36. Also shown schematically are the extinguishing containers, which are numbered, as are parts thereof, as in FIG. 1.

The invention has been particularly described with respect to its preferred embodiments, but it will be apparent to those skilled in the art that many variations and modifications may be made. The invention is accordingly not to be regarded as limited to such embodiments, rather its scope will be defined in the claims which follow:

We claim:

1. A module for use in a fire extinguishing system and comprising:

a housing, having a bottom panel;

detector means extending through a first hole in said bottom panel to just below the plane of said bottom panel, for detecting characteristics of a fire or an incipient fire;

control means adapted to be actuated by detection at said detector means;

fire extinguishing means adapted to be discharged by said control means, said fire extinguishing means comprising at least one container filled with extinguishing agent and terminated by a discharge valve, and a nozzle connected to said discharge valve, said nozzle comprising a deflector, extending through a second hole in said bottom panel distinct from said first hole and ending just below said bottom panel so that said bottom panel acts as a shield against turbulence; and;

a winch assembly, comprising a pulley and pulley line, connected to the top of said at least one container for lowering said at least one container.

2. A module according to claim 1 wherein the detector means is selected from smoke, heat and radiation detector means.

3. A module according to claim 2 wherein the detector means comprises ultraviolet radiation detector means.

4. A module according to claim 2 wherein the detector means comprises infrared radiation detector means.

5. A module according to claim 1, wherein said discharge valve is further adapted to discharge said extinguishing agent by radio-activation of said control means in response to manual operation of a remote control means.

6. A module according to claim 5 wherein said discharge valve is further adapted to discharge said extinguishing agent by action of thermal sensor means contained within the valve.

7. A module according to claim 1, wherein the fire extinguishing means comprises at least one container filled with essentially pure promotrifluoromethane as extinguishing agent, and terminated by a discharge valve.

8. A module according to claim 1 wherein said control means comprises a logic circuit means.

9. A module according to claim 8 wherein said logic circuit means is adapted to discharge said first extinguishing means by generation of an electrical pulse.

10. In a computer room having one or more computers and, optionally, air conditioning and other electrical apparatus, a ceiling including a suspension grid of supports supporting a plurality of removable tiles, the periphery of each tile being supported by supports defining a border of one block of the suspension grid, and means for protecting the contents thereof against fire, the improvement wherein said fire protection means is installed in the ceiling and comprises:

a housing having a bottom panel, said bottom panel residing within a set of said supports enclosing a space having a size and shape of one or more whole blocks of said grid, said bottom panel having essentially the same size and shape as a structure consisting of one or more of said removable tiles;

first detector means for detection characteristics of a fire or an incipient fire extending through a first hole in said bottom panel to just below said bottom panel;

control means adapted to be actuated by detection at said detector means;

fire extinguishing means adapted to be discharged by said control means, said fire extinguishing means comprising at least one container filled with extinguishing agent and terminated by a discharge valve, and a nozzle connected to said discharge valve, said nozzle comprising a deflector, extending through a second hole in said bottom panel distinct from said first hole and ending just below said bottom panel so that said bottom panel acts as a shield aginst turbulence; and a winch assembly comprising a pulley and pulley line connected to the top of said at least one container for lowering said at least one container;

wherein said control means is further adapted, when actuated by said first detector means to switch off said one or more computers or other electrical apparatus.

11. A room according to claim 10, wherein said control means is still further adapted, when actuated by said first detector means, to trigger alarm means.

12. A room according to claim 11 wherein said alarm means includes at least one of the following, namely, a bell, a siren, and a visual alarm unit, any of which may be located inside or outside of the room, and an automatic dialer.

13. A room according to claim 11, having a second detector means, remote from said housing, for detecting a fire or an incipient fire and relaying said detection to said control means.

* * * * *